US008281965B2

(12) United States Patent
Chan

(10) Patent No.: US 8,281,965 B2
(45) Date of Patent: Oct. 9, 2012

(54) GARMENT HANGER WITH TOP SIZER

(75) Inventor: King Keung Kennedy Chan, Hong Kong (HK)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 418 days.

(21) Appl. No.: 12/613,030

(22) Filed: Nov. 5, 2009

(65) Prior Publication Data

US 2011/0101044 A1 May 5, 2011

(51) Int. Cl.
*A41D 27/22* (2006.01)

(52) U.S. Cl. ..... 223/85; 40/322

(58) Field of Classification Search ..... 223/85; 40/322

See application file for complete search history.

(56) References Cited

U.S. PATENT DOCUMENTS

| | | | | |
|---|---|---|---|---|
| 3,949,914 | A * | 4/1976 | Ostroll | 223/85 |
| 4,045,899 | A | 9/1977 | Richardson | |
| 4,881,836 | A * | 11/1989 | Blanchard | 40/322 |
| 4,951,855 | A * | 8/1990 | Jacobson et al. | 223/88 |
| 4,997,114 | A * | 3/1991 | Petrou | 223/85 |
| 5,236,109 | A * | 8/1993 | Zuckerman | 223/85 |
| 5,411,189 | A * | 5/1995 | Gouldson | 223/85 |
| 5,884,422 | A * | 3/1999 | Marshall et al. | 40/322 |
| D441,823 | S | 5/2001 | Blackhurst | |
| 6,516,980 | B1 * | 2/2003 | Goldman | 223/85 |
| D510,198 | S | 10/2005 | Willardson | |
| D528,807 | S | 9/2006 | Mainetti | |
| D536,180 | S | 2/2007 | Wu | |
| D536,181 | S | 2/2007 | Wu | |
| D547,557 | S | 7/2007 | Wu | |
| 7,240,813 | B1 | 7/2007 | Goldman | |
| D552,361 | S | 10/2007 | Goldman | |
| 7,287,674 | B1 | 10/2007 | Sutton et al. | |
| D554,378 | S | 11/2007 | Niederer | |
| 7,303,101 | B2 | 12/2007 | Goldman | |
| 8,141,756 | B2 | 3/2012 | Mainetti | |
| 2006/0006204 | A1 | 1/2006 | Mainetti | |
| 2006/0213938 | A1 | 9/2006 | Gouldson | |
| 2007/0062984 | A1 | 3/2007 | Louw | |
| 2009/0120973 | A1 | 5/2009 | Ho | |
| 2010/0270338 | A1 * | 10/2010 | Mainetti | 223/85 |

* cited by examiner

*Primary Examiner* — Nathan Durham
(74) *Attorney, Agent, or Firm* — Leason Ellis LLP

(57) ABSTRACT

In accordance with one embodiment, a garment hanger for use with a top sizer clip includes a body having a cross bar and a hook member extending outwardly therefrom. The hook member includes a web portion having an inner edge and an opposing outer edge, wherein the hook member terminates in a curved distal end and includes a neck portion that connects the hook member to the cross bar. The neck portion is defined by a portion of the outer edge that faces one end of the cross bar and a portion of the inner edge that faces an opposite end of the cross bar. The outer edge in the neck portion has a concave shape, while the inner edge in the neck portion has a convex shape.

11 Claims, 4 Drawing Sheets

Fig. 7
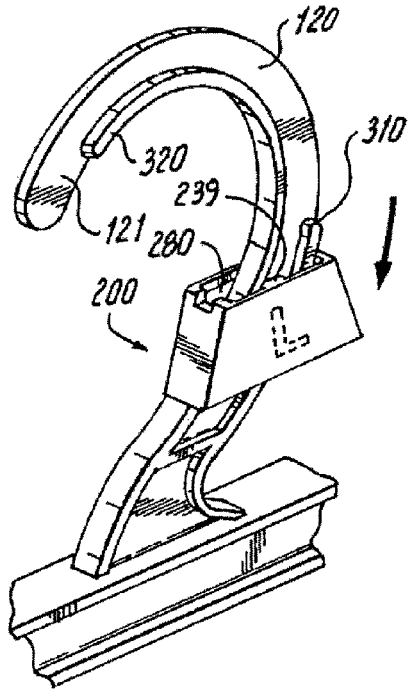
Fig. 8
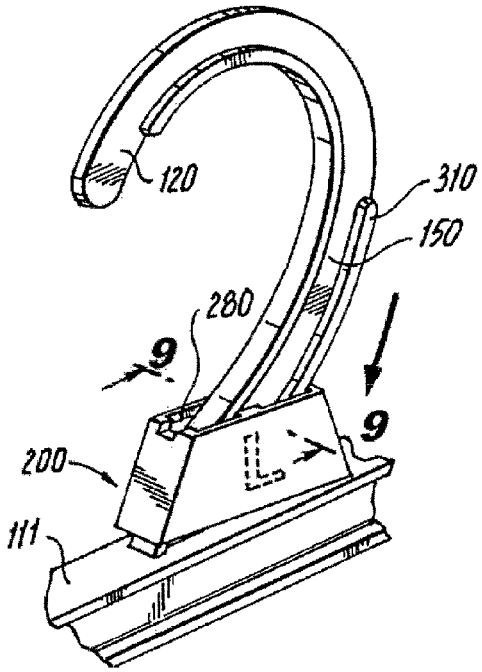
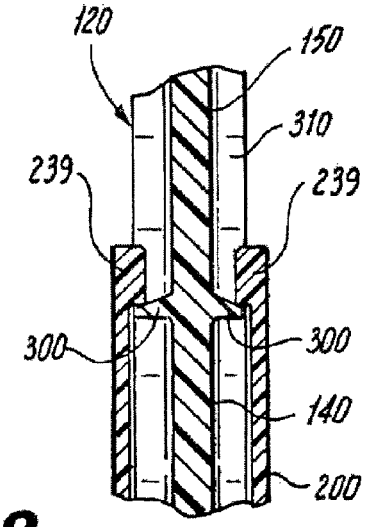
Fig. 9

Fig. 10
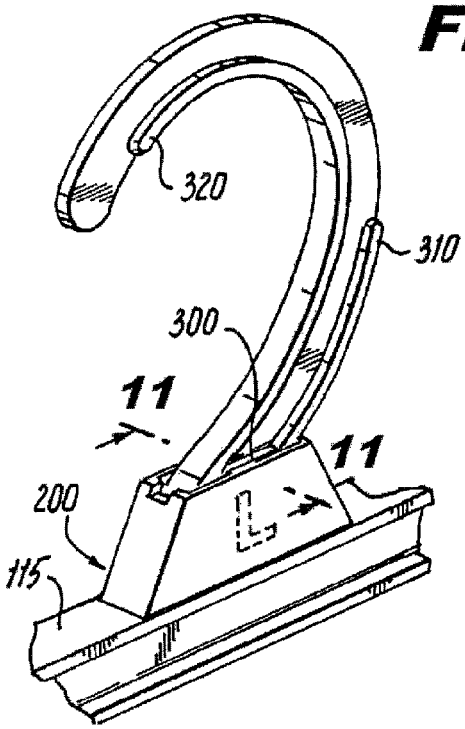
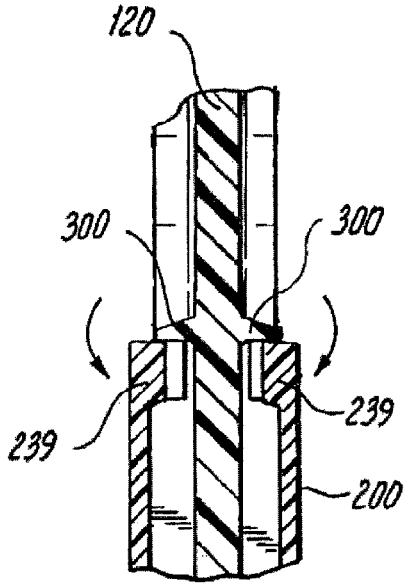
Fig. 11
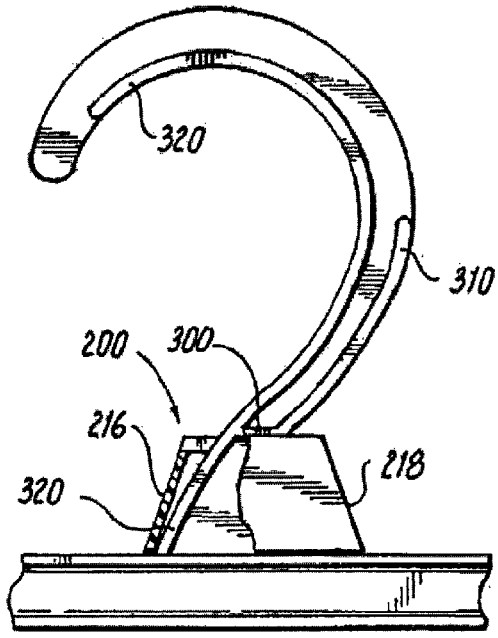
Fig. 12

GARMENT HANGER WITH TOP SIZER

TECHNICAL FIELD

The present invention relates to a garment hanger of the type which includes a locking information clip and more particularly, to a top sizer clip for use with the garment hanger.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

SUMMARY

In accordance with one embodiment, a garment hanger for use with a top sizer clip includes a body having a cross bar and a hook member extending outwardly therefrom. The hook member includes a web portion having an inner edge and an opposing outer edge, wherein the hook member terminates in a curved distal end and includes a neck portion that connects the hook member to the cross bar. The neck portion is defined by a portion of the outer edge that faces one end of the cross bar and a portion of the inner edge that faces an opposite end of the cross bar. The outer edge in the neck portion has a concave shape, while the inner edge in the neck portion has a convex shape.

In another embodiment, the hanger has at least one raised locking rail extending across the web between the inner and outer edges of at least one face of the web for locking a top sizer clip in place on the hook member.

In another embodiment, a top sizer clip in combination with a hanger having a body and a hook member is provided. The combination includes a top sizer clip body having a pair of side walls and end walls joined to and extending between the side walls. The body includes a top wall that is joined to upper edges of the side walls and end walls. The top wall partially encloses the body so as to create a hollow body structure that includes an interior compartment defined by the end walls, side walls, and top wall. The top wall includes an opening formed therein for receiving a hook member of the hanger. The opening is defined by a pair of opposing side edges, wherein the side edges include a pair of locking detents that extend inwardly into the opening toward one another so as to define a minimum width of the opening.

The hook member is coupled to a cross bar of the hanger and extends outwardly therefrom. The hook member includes a web portion having an inner edge and an opposing outer edge. The hook member terminates in a curved distal end and includes a neck portion that connects the hook member to the cross bar. The neck portion is defined by a portion of the outer edge that faces one end of the cross bar and a portion of the inner edge that faces an opposite end of the cross bar. At least one raised locking rail extends horizontally across the web between the inner and outer edges of at least one face of the web for locking the top sizer clip in place on the hook member by engaging the locking detents on an underside of the locking rail.

In another embodiment, a method for locking a top sizer clip on a hook member of a garment hanger that includes a web having an inner edge and an opposing outer edge and a distal end includes the steps of: (a) providing a first raised wall along a length of the inner edge of the hook member, the first raised wall extending outwardly from the web portion, wherein a length; (b) providing a second raised wall along a length of the outer edge of the hook member, the second raised wall extending outwardly from the web portion, wherein a length of the first raised wall extends along a length of the inner edge that is less than the entire length of the inner edge as measured from the crossbar to the distal end and the raised second edge extends along a length of the outer edge that is less than the entire length of the outer edge as measured from the cross bar to the distal; (c) providing a horizontal locking rail that is formed along at least one face of the hook member and extends between the raised first and second walls; (d) inserting the top sizer clip on the web portion such that the distal end is received into a hollow interior thereof, wherein a top wall of the top sizer clip has an opening formed therein through which the web portion extends, the opening being defined by a pair of opposing side edges, wherein the side edges include a pair of locking detents that extend inwardly into the opening toward one another so as to define a minimum width of the opening; (e) moving the top sizer clip along the web portion to cause the locking detents to first contact an inner surface of the first raised wall and then subsequently contact an inner surface of the second raised wall as the top sizer clip is moved along the web portion toward the cross bar, wherein the locking detents ride into a track defined along the web portion between the first and second raised walls; and (f) locking the top sizer in place on the hook member by engaging the locking detents to an underside of the horizontal locking rail formed along the web portion.

Other features and advantages of the present invention will be apparent from the following detailed description when read in conjunction with the accompanying drawings.

BRIEF DESCRIPTION OF THE DRAWINGS FIGURES

The foregoing and other features of the present invention will be more readily apparent from the following detailed description, and drawings figures of illustrative embodiments of the invention in which:

FIG. 7 is a local perspective view, partially broken away, of the hook member with the top sizer clip shown in a third position prior to being locked in place;

FIG. 8 is a local perspective view, partially broken away, of the hook member with the top sizer clip shown in a fourth position just prior to being locked in place;

FIG. 9 is a cross-sectional view taken along the line 9-9 of FIG. 8;

FIG. 10 is a local perspective view, partially broken away, of the hook member with the top sizer clip shown in the locked position;

FIG. 11 is a cross-sectional view taken along the line 10-10 of FIG. 10; and FIG. 12 is a side elevation view, partially broken away, of the top sizer clip in the locked position.

DETAILED DESCRIPTION OF EMBODIMENTS

Figure 1:
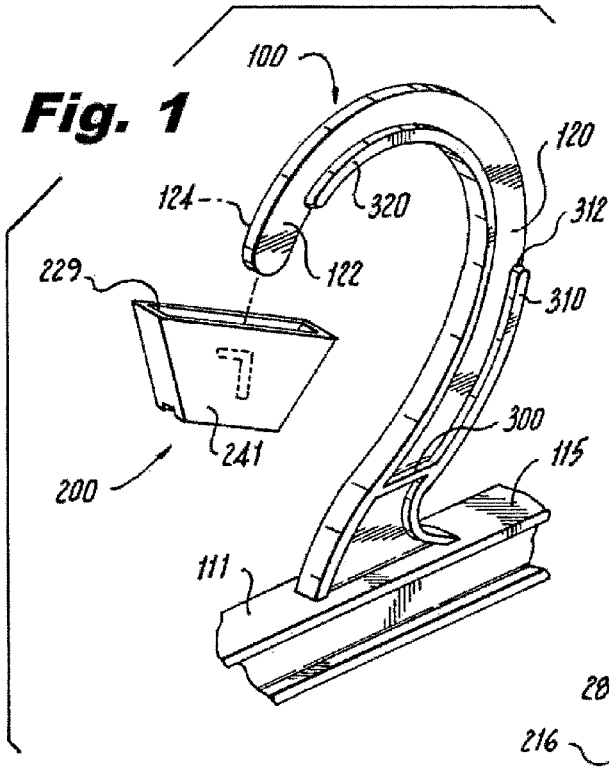
FIG. 1 is a local perspective view, partially broken away, of a hook member of a garment hanger with a top sizer clip shown exploded therefrom according to the present invention.

FIG. 1 is a top and side perspective view of a portion of a garment hanger 100 that includes a body portion that includes across bar 111 having two opposing ends and a hook member 120 that is attached to the body portion 110. A top sizer clip (indicator) 200 according to the present invention is shown in an exploded manner relative to the hook member 120. As described below, the top sizer clip 200 is constructed to intimately engage and be securely, yet releasably, attached to a portion of the hook member 120. It will be appreciated that the garment hanger 100 can have any number of conventional constructions, including having a body portion that is of a flat bar type suitable for holding a top or the like. However, the garment hanger 100 can be of the type that includes a clamp or grip assembly formed near or at each of the first and second ends for holding a pant or the like. The grip assemblies can be integrally formed with the body portion at the first and second ends. It will be appreciated that the garment hanger 100 and/or the top sizer clip indicator 200 can be formed of either an opaque material or transparent material, etc.

In the illustrated embodiment, the hanger 100 is of the type that is referred to as a bra and panty hanger. The hanger 100 includes two clamp assemblies (not shown) that are formed at the two opposing ends of the body of the hanger 100. In the case of a bra and panty type hanger, each clamp assembly is designed to grasp and engagingly hold bras and panties. Each clamp assembly includes three distinct flexible fingers that engage either the bra or panty. The fingers are generally parallel to one another and are located on opposite sides of the cross bar 111. The fingers are generally in the form of horizontal fingers, while the finger is in the form of a vertical finger at one end of the cross bar 111.

The body portion of the garment hanger, including any clamp or grip assemblies and including the hook member 120, is preferably made as a single piece, molded in plastic using a plastic injection molding machine, as understood by those skilled in the art. Any appropriate plastic can be used, such as styrene, which provides a clear, virtually transparent hanger and alternatively, the hanger 100 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

One exemplary type of garment hanger 100 is shown in commonly assigned U.S. design Pat. No. D453,423.

The illustrated garment hanger 100 is of a fixed hook type construction in that the hook member 120 for fixed attachment to the body portion at a location that is generally at a midpoint along the body portion (cross bar 111).

Now referring to FIGS. 1-4, unlike the hook member in the '423 patent, the hook member 120 of the garment hanger 100 is configured to receive and lockingly engage the top sizer clip 200. The hook member 120 can be thought of as including at least three different sections, namely, a neck portion 140, a curved intermediate portion 150 and a curved end portion 160.

The neck portion 140 is the lower portion of the hook member 120 that interfaces with the cross bar 111, while the curved end portion 160 is a free end portion that contacts a support member, such as pole, that supports the hanger 100. The intermediate portion 150 is that portion of the hook member 120 that is located between the curved end portion 160 and the neck portion 140.

It will be appreciated that the hook member 120 is formed of a web 121 that has a hook shape and is integrally formed with the crossbar 111. The hook member 120 and in particular, the web 121 has a first face or surface 122 and an opposing second face or surface 124 and has an inner edge 126 and an opposing outer edge 128. Both the inner and outer edges 126, 128 extend from the cross bar 111 to the free end at the curved end portion 160.

In accordance with the present invention, the neck portion 140 is defined by an arcuate or curved inner edge section 142 and an arcuate or curved outer edge section 144. The curved outer edge section 144 represents a concave shaped edge that smoothly transitions from an interface with the cross bar 111 to the outer edge 128 of the intermediate portion 150. In contrast to conventional hook member neck portions that have an inner edge that is linear in nature, the curved inner edge section 142 has a smooth convex shape.

The curved inner edge section 142 is designed to provide a smooth edge that flows from the interface between the cross bar 111 and the section 142 up to the intermediate portion 130.

In other words, in conventional hook member neck portions, the inner edge is a linear edge that intersects the cross bar 111 and forms a joint with the inner edge of the intermediate portion 150.

The hook member 120 includes at least one locking rail or bar 300 that is designed to engage the top sizer clip indicator 200.

The locking rails 300 are in the form of horizontal rails that extend between the inner edge 126 and the outer edge 128 on at least one of the faces 122, 124. In the illustrated embodiment, the locking rail 300 is formed on each face 122, 124. In other words, the locking rails 300 are formed opposite one another on the opposite faces 122, 124. One exemplary horizontal locking rail 300 intersects the inner edge 126 and outer edge 128 and in particular, the locking rail 300 forms a right angle to the inner edge 126 and the outer edge 128.

In accordance with the present invention, the inner and outer edges 126, 128 of the hook member have raised walls along selective sections of the inner and outer edges 126, 128 to provide additional structural support. For example and with reference to FIGS. 1 and 4, the outer edge 128 includes a first raised wall or rib 310 that extends along the outer edge 128 from the crossbar 111 to a point 312 along the outer edge 128. The point 312 is a point that is proximate or at an interface between the intermediate portion 150 and the curved end portion 160. In other words, the point 312 can represent a point that is near the top of the intermediate portion 150.

The raised wall 310 thus extends outwardly from the web 121 of the hook member 120 and smoothly transitions and flows into the top wall 115 of the cross bar 111. From the point 312 to the free end of the hook member 120, the outer edge 128 is free of an upstanding structure and only the web 121 is present in this region. At point 312, the raised wall 310 terminates in a beveled surface (edge).

The inner edge 126 includes a second raised wall or rib 320 that extends along the inner edge 126 from the crossbar 111 to a point 314 along the inner edge 126. The point 314 is a point that is proximate to the free end of the curved end portion 160. The second raised wall 320 thus extends only along a portion of the inner edge 126 and does not extend along the entire length of the inner edge 126. From the point 314 to the free end of the hook member 120, the web 121 is planar section with no raised walls.

The raised wall 320 thus extends outwardly from the web 121 of the hook member 120 and smoothly transitions and flows into the top wall 115 of the cross bar 111. At point 314, the raised wall 320 terminates in a beveled surface (edge).

Unlike conventional design, the raised wall 320 along the inner edge 126 has a slightly curved shape and smoothly transitions from the cross bar 111 to the intermediate portion 150 without any ridge or obstruction formed at the interface between the neck portion 140 and the intermediate portion 150. In other words, the raised wall 320 has a convex shape and smoothly transitions into the intermediate portion where the raised wall 320 has a slightly concave shaped. As the raised wall 320 transitions from the intermediate portion 150 to the curved end portion 160, the degree of concavity of the raised wall 320 increases since the radius of curvature of the inner edge 126 is greatest along the curved end portion 160.

It will be apparent from the Figures that the length of the raised wall 320 is greater than the raised wall 310. Not only do the raised walls 310, 320 provide structural integrity but they also provide an aesthetic look for the hook member 120 that is different than conventional hook members where the raised walls along the inner and outer edges extends completely from the crossbar to the free, distal end of the curved hook member.

In an illustrated embodiment, the distance from the inner edge 126 at its apex (identified by point A in the FIG. 4) to the top wall 115 of the cross bar 111 is about 2.30 inches. In addition, the distance from a point C that is located at the free end of the hook member 120 to a point D that lies within the neck portion 140 is about 1.50 inches.

The horizontal locking rails 300 are located generally at an interface between the neck portion 140 and the intermediate portion 150. The width of the horizontal locking rail 300 can be less than, equal to, or approximately the same as a width of the raised walls 310, 310 formed along the outer and inner edges 128, 126, respectively, of the hook member 120. In the illustrated embodiment, the width of the locking rail 300 is less than the width of the inner and outer edges 126, 128 of the hook member 120. Similarly, the height of the locking rail 300 can be less than or about equal to the heights of the raised walls 310, 310 formed along the outer and inner edges 128, 126, respectively, of the hook member 120.

The height of the locking rail 300 and the inner and outer edges 126, 128 is determined by and measured from a web 121 of the hook member 120 that is located between the inner and outer edges 126, 128.

It will also be appreciated that a top wall 115 of the cross bar 111 can have a different width at a general location of where the hook member 120 joins the cross bar 111. More specifically, the top wall 115 can have a greater width in this region where the hook member 120 joins the cross bar 111. This provides additional structural support in this load bearing region of the hanger since the hook member 120 is coupled to the support member (clothing rack) and supports the weight of the garment or the like along the cross bar 111. The top wall 115 can flare outwardly and achieve a maximum width for a distance of either side of the hook member 120 and at the hook member 120 itself.

The curved inner edge section 142 is configured so that at the location where the curved inner edge section 142 intersects the locking rail 300, there is a smooth transition between the inner edge section 142 and the inner edge of the intermediate portion 150. In other words, there are no sharp edges at the joint between the inner edge of the neck portion 140 and the inner edge of the intermediate portion 150. This is in contrast to conventional hanger design where there is a ridge or a bump between these two sections due to the linear nature of this edge section.

In addition, the hook member 120 has been modified for improved coupling and retention between the hanger 100 and a support member, such as a clothing rack or the like. More specifically, the uppermost arcuate edge of a conventional rounded hook member 120 has been removed and modified to allow for reception and locking with the top sizer clip 200. Instead, the web 121 is designed for removably securing the top sizer clip 200 to the garment hanger 100. The web 121 defines the topmost structure of the hook member 120 and at this topmost structure, only the web 121 is present since the raised wall 310 is absent from the hook member 120 in this region.

It will be appreciated that each of the opposing faces of the web 121 includes one raised wall 310 along its outer edge and one raised wall 320 along its inner edge. The thickness of the hook member is therefore variable and in particular, the hook member 120 includes three distinct regions of thickness, namely, a first thickness at the distal end of the web 121 where neither the raised walls 310, 320 exist; and a second thickness where the web 121 includes one or both of the raised walls 310, 320. The first thickness is less than the second thickness.

Figure 2:
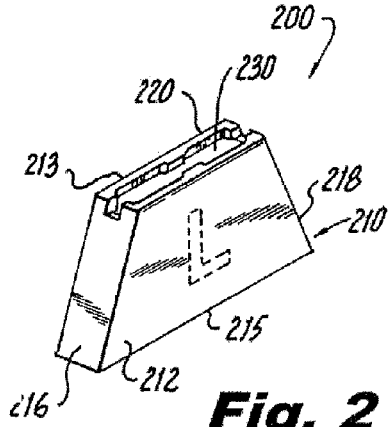
FIG. 2 is a top and side perspective view of the top sizer clip of FIG. 1.
Figure 3:
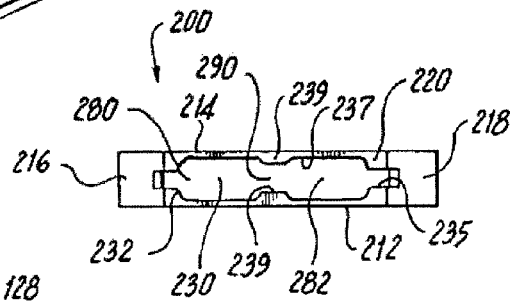
FIG. 3 is a top plan view of the top sizer clip.
Figure 4:
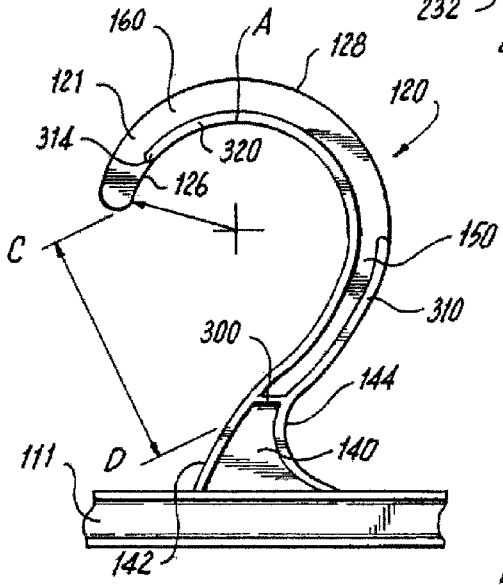
FIG. 4 is side elevation view of the hook member.

FIGS. 2-3 illustrate the top sizer clip 200 according to one embodiment of the present invention. The top sizer clip 200 is formed of a clip body 210 that is essentially hollow and is defined by a first side wall 212, an opposing second side wall 214, a first end wall 216, an opposing second end wall 218, and a top wall 220. The bottom of the top sizer clip 200 is open so as to permit the top sizer clip 200 to be inserted over the hook member 120 and then securely attached to the hanger 100 as described below.

While the top sizer clip 200 can be formed of any number of different materials, the clip 200 is typically made from a plastic material using conventional techniques, such as molding techniques, e.g., injection molding. The clip 200 can be either opaque in nature or semi-transparent or transparent and can be formed to have any number of different colors.

Each of the first and second side walls 212, 214 can have a substantially parallelogram shape in that top and bottom edges 213, 215, respectively, thereof are parallel and the two end walls 216, 218 join the side walls 212, 214 at an angle such that the ends are beveled walls with respect to a ground surface (bottom edge 215).

The end walls 216, 218 extend between the two side walls 212, 214 and are joined at their top edges 217 to the top wall 220. The end walls 216, 218 can have any number of different shapes. For example, the end walls 216, 218 can have a planar outer surface/face or can have a rounded shape.

As best shown in FIG. 1, the body 210 of the top sizer clip 200 has an inner surface 229 and an opposing outer surface 241. The inner surface 230 of the clip 200 is defined by an inner face formed as part of each side wall 212, 214 and each end wall 216, 218.

The top wall 220 is joined along its peripheral edge to the side walls 212, 214 and the end walls 216, 218. The top wall 220 includes an opening 230 that is formed therethrough and provides an entrance into an interior 240 of the top sizer clip 200. The opening 230 has a predetermined shape and includes a pair of features 235 that are formed in the top wall 220 and communicate with and are associated with the opening 230. More specifically, the features 235 are in the form of notches or slots that are formed along end edges 232 that define the opening 230. As best shown in FIG. 3, the notches 235 are formed in the same locations of the respective end edges 232 (opposite one another). For example, the notches 235 are formed in the central sections or regions of the end edges 232.

In addition to the end edges 232, the opening 230 is defined by a pair of side edges 237 that extend between the end edges 232. In one embodiment, as shown, each side edge 237 is not a smooth, uniform edge but rather includes a section 239 of increased width. In other words, section 239 is a non-uniform section that protrudes inwardly into the opening 230. The sections 239 are designed to create interference and serve as locking members or locking detents for engaging the locking rails 300 formed along the web 121 of the hook member 120 to securely lock the top sizer clip 200 in place as described in detail below. The sections 239 are located opposite one another and typically, are located in the centers of the side edges 237 and thus, in the center of the opening 230.

The opening 230 thus includes first regions 280, 282 that define the maximum width of the opening 230 and a second region 290 that defines the minimum width of the opening 230. The first regions 280, 282 are located on each side of the sections 239 (i.e., the section 239 and second region 290 are located intermediate the first regions 280, 282).

In the illustrated embodiment, the section 239 is a convex shaped region that is formed along a length of the side edge 237. Moreover, it will be appreciated that the entire side edge 237 can itself have a generally convex shape. In addition, the non-uniform section 239 formed along each side edge 237 can have another shape, such as a rectangular step that is formed centrally along the length of the side edge 237. Alternatively, the section 239 can be in the form of an inwardly pointed section that can have a rounded tip. Since the top sizer clip 200 is formed of plastic, the sections 239 have some resiliency and therefore can flex when they are engaged by another member.

The width of the opening 230 is thus at a minimum between the sections 239 since the sections 239 are designed as locking edges that securely lock the top sizer clip 200 in place on the hook member 120. In particular, the sections 239 engage the locking rails 400 and thereby lock the top sizer clip 200 onto the hook member 120.

It will also be appreciated that the length of each section 239 (as measured along the length of the side wall 237) is about equal to or less than the distance between the raised walls 310, 320. In other words, when the clip 200 is inserted onto the hook member 120 and is moved down toward the crossbar 111, each section 239 is received between the raised walls 310, 320 where the section 239 can travel along the web 121 between the raised walls 310, 320.

It will be appreciated that the reception of the sections 239 between the raised walls 310, 320 serves to locate and retain the clip 200 on the hook member 120.

Figure 5:
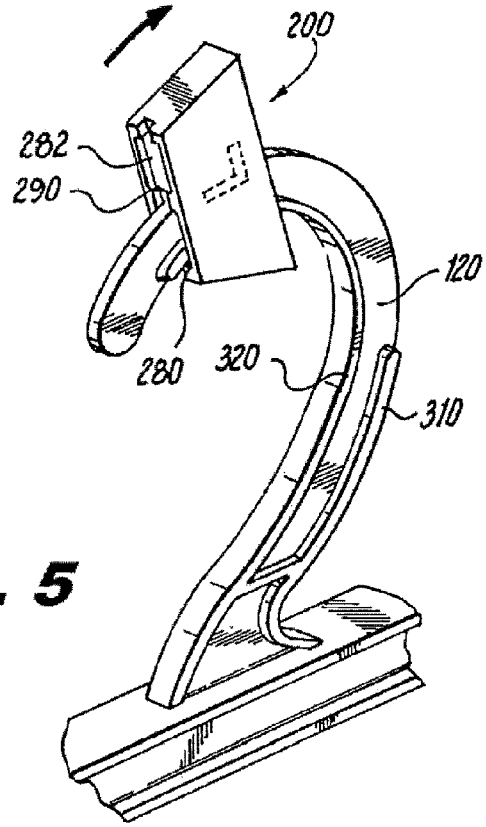
FIG. 5 is a local perspective view, partially broken away, of the hook member with the top sizer clip shown in a first position prior to being locked in place.

The process of securely attaching the top sizer clip 200 to the hanger 100 is now described with reference to FIGS. 4-12. As shown in FIG. 1, the top sizer clip 200 is first aligned relative to the hanger 100 such that the bottom edge 215 of the clip 200 and the interior thereof face the hook member 120. The free, distal end of the hook member 120 is inserted into the interior 240 of the clip 200 such that the distal end passes through the opening 230 formed in the top wall of the clip 200 as shown in FIG. 5. The distal end of the hook member 120 can freely pass through the opening 230 in the regions 280, 282 where the opening 230 is at a maximum width. When the distal end of the hook member 120 is inserted into the region 290 located between the sections 239, the web 121 of the hook member 120 can pass freely between the sections 239; however, when the raised walls 320 on each face of the web 121 encounter the sections 239, the clip 200 does not freely travel between the sections 239 but rather there an interference is created by the sections 239. The distance between the side walls 237 in this region is about equal to the second thickness of the hook member 120 (i.e., the portion of the hook member that contains the raised walls). When the raised walls of the hook member 120 is inserted into one of the regions 280, the raised walls can slightly contact the side walls 237 and can form a frictional fit; however, the hook member 120 can pass through this region 280, 282 by applying a force and directing the clip 200 down the hook member 120 toward the crossbar 111.

Figure 6:
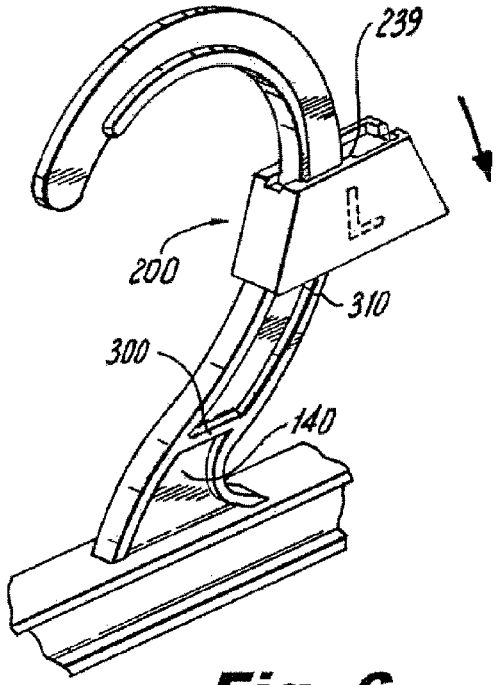
FIG. 6 is a local perspective view, partially broken away, of the hook member with the top sizer clip shown in a second position prior to being locked in place.

For properly locking the clip 200 to the hook member 120, the free distal end of the hook member 120 is thus inserted into the region 280 of the opening since in this position, as the clip 200 is moved down the hook member 120 toward the crossbar 111, the sections 239 are guided into contact within an inner' face of the raised walls 320. Continued movement of the top sizer 200 down the hook member 120 causes the sections 239 to be guided into position between the inner faces of the raised walls 310, 320 as shown in FIGS. 6 and 7. In other words, first ends of the sections 239 contact the inner faces of the raised walls 320, while second ends of the sections 239 contact the inner faces of the raised walls 310 and the widest portions of the sections 239 ride along the web 121 between the raised walls 310, 320.

The top sizer clip 200 is moved down the hook member 120 with the hook member 120 being located in the region 280 and then the sections 239 are moved into position between the raised walls 310, 320 as shown in FIGS. 7 and 8. When the clip 200 encounters the raised walls 310, 320, the raised walls 320 are disposed within the region 280 and the raised walls 310 are disposed within the region 282.

The sections 239 continue to ride along the web 121 between the raised walls 310, 320 until the sections 239 encounter the top of the locking walls 400 as shown in FIGS. 8 and 9. Continued movement of the clip 200 toward the crossbar 111 causes flexing of the sections 239 and results in the sections 239 flexing into engagement with the underside (bottom edge) of the locking wall 400, thereby locking the clip 200 on the hook member 120 as shown in FIGS. 10 and 11. In the locked position of FIGS. 10 and 11, the bottom edge of clip 200 seats against the top wall 115 of the crossbar 111. In addition, in the locked position as shown in FIG. 12, the raised walls 320 are disposed proximate to or in adjacent contact with end wall 216 of the top sizer clip 200, while a space or gap is formed between the raised wall 310 and the end wall 218. In other words, the top sizer clip is not positioned uniformly on the neck portion but rather is in an off-centered manner due to the irregular shape of the neck portion.

It will be appreciated that the inner edge of the hook member, unlike conventional hook design, is defined by a continuous non-linear surface. In other words, from the cross-bar to the distal end of the hook member, the inner edge of the hook member has a radius of curvature that varies depending upon the section of the hook member; however, the inner edge does not include a linear or flat portion.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A top sizer clip in combination with a hanger having a body and a hook member comprising:

a top sizer clip body having a pair of side walls and end walls joined to and extending between the side walls, the body including a top wall that is joined to upper edges of the side walls and end walls, the top wall partially enclosing the body so as to create a hollow body structure that includes an interior compartment defined by the end walls, side walls, and top wall, wherein the top wall includes an opening formed therein for receiving a hook member of the hanger, the opening defined by a pair of opposing side edges, wherein the side edges include a pair of locking detents that extend inwardly into the opening toward one another so as to define a minimum width of the opening;

the hook member being coupled to a cross bar of the hanger and extends outwardly therefrom, the hook member including a web portion having an inner edge and an opposing outer edge, wherein the hook member terminates in a curved distal end and includes a neck portion that connects the hook member to the cross bar, wherein the neck portion is defined by a portion of the outer edge that faces one end of the cross bar and a portion of the inner edge that faces an opposite end of the cross bar; and at least one raised locking rail extending horizontally across the web between the inner and outer edges of at least one face of the web for locking the top sizer clip in place on the hook member by engaging the locking detents on an underside of the locking rail.

2. The combination of claim 1, wherein the outer edge in the neck portion has a concave shape, while the inner edge in the neck portion has a convex shape.

3. The combination of claim 1, wherein the top sizer clip snap-lockingly engages the locking rail and in a locked position, a bottom edge of the top sizer sits against a top edge of the cross bar.

4. The combination of claim 1, further including a raised first edge formed on at least one face of the web that extends along a length of the inner edge and a raised second edge formed on the at least one face that extends along a length of the outer edge.

5. The combination of claim 4, wherein the raised first edge extends along a length of the inner edge that is less than the entire length of the inner edge as measured from the cross bar to the distal end and the raised second edge extends along a length of the outer edge that is less than the entire length of the outer edge as measured from the cross bar to the distal end.

6. The combination of claim 5, wherein the length of the raised first edge is greater than the length of the raised second edge.

7. The combination of claim 4, wherein hook member comprises a distal end portion that terminates in the curved distal end and an intermediate portion that is disposed between the distal end portion and the neck portion, wherein only the raised first edge is present within the distal end portion and the raised first and second edges are presented within each of the intermediate portion and the neck portion.

8. The combination of claim 4, wherein a distance between the first and second raised walls is approximately equal to a length of the locking detents as measured along the respective side edges.

9. The combination of claim 1, wherein the at least one raised locking rail comprises a pair of horizontal locking rails, with one locking rail being located on one face and the other locking rail being located on an opposite face of the web.

10. A method for locking a top sizer clip on a hook member of a garment hanger that includes a web having an inner edge and an opposing outer edge and a distal end, comprising the steps of:

providing a first raised wall along a length of the inner edge of the hook member, the first raised wall extending outwardly from the web portion, wherein a length;providing a second raised wall along a length of the outer edge of the hook member, the second raised wall extending outwardly from the web portion, wherein a length of the first raised wall extends along a length of the inner edge that is less than the entire length of the inner edge as measured from the cross bar to the distal end and the raised second edge extends along a length of the outer edge that is less than the entire length of the outer edge as measured from the cross bar to the distal;

providing a horizontal locking rail that is formed along at least one face of the hook member and extends between the raised first and second walls;

inserting the top sizer clip on the web portion such that the distal end is received into a hollow interior thereof, wherein a top wall of the top sizer clip has an opening formed therein through which the web portion extends, the opening being defined by a pair of opposing side edges, wherein the side edges include a pair of locking detents that extend inwardly into the opening toward one another so as to define a minimum width of the opening;

moving the top sizer clip along the web portion to cause the locking detents to first contact an inner surface of the first raised wall and then subsequently contact an inner surface of the second raised wall as the top sizer clip is moved along the web portion toward the cross bar, wherein the locking detents ride into a track defined along the web portion between the first and second raised walls; and locking the top sizer in place on the hook member by engaging the locking detents to an underside of the horizontal locking rail formed along the web portion.

11. A top sizer clip in combination with a hanger having a body and a hook member comprising:

a top sizer clip having a hollow body that includes a top wall, the hollow body including a hollow interior compartment, wherein the top wall includes an opening formed therein for receiving a hook member of the hanger, the opening defined by a pair of opposing side edges, wherein the side edges include a pair of locking detents that are directly opposite one another and extend inwardly into the opening toward one another;

the hook member being coupled to a cross bar of the hanger and extends outwardly therefrom, the hook member including a web portion having a first face, a second face, an inner edge and an opposing outer edge, wherein the hook member terminates in a curved distal end and includes a neck portion that connects the hook member to the cross bar, wherein the neck portion is defined by a portion of the outer edge that faces one end of the cross bar and a portion of the inner edge that faces an opposite end of the cross bar;

a raised first edge formed on at least one face of the web that extends along a length of the inner edge;

a raised second edge formed on the at least one face that extends along a length of the outer edge, wherein the raised first edge extends along a length of the inner edge that is less than the entire length of the inner edge as measured from the cross bar to the distal end and the raised second edge extends along a length of the outer edge that is less than the entire length of the outer edge as measured from the cross bar to the distal end; and a pair of raised locking rails with a first locking rail formed along the first face of the web portion and a second locking rail formed along the second face of the web portion, each locking rail extending horizontally across the web portion between the raised first and second edges formed along the inner and outer edges, respectively, of the web portion for locking the top sizer clip in place on the hook member by engaging the locking detents on an underside of the locking rail.

* * * * *